US011767684B2

(12) United States Patent
Wagner, III

(10) Patent No.: US 11,767,684 B2
(45) Date of Patent: Sep. 26, 2023

(54) CAMOUFLAGED PORTABLE TOILET

(71) Applicant: Fred A. Wagner, III, Charlotte, NC (US)

(72) Inventor: Fred A. Wagner, III, Charlotte, NC (US)

( * ) Notice: Subject to any disclaimer, the term of this patent is extended or adjusted under 35 U.S.C. 154(b) by 468 days.

(21) Appl. No.: 17/158,580

(22) Filed: Jan. 26, 2021

(65) Prior Publication Data

US 2021/0238879 A1 Aug. 5, 2021

Related U.S. Application Data

(60) Provisional application No. 62/967,632, filed on Jan. 30, 2020.

(51) Int. Cl.
*E04H 15/02* (2006.01)
*E04H 15/34* (2006.01)
*A47K 11/04* (2006.01)

(52) U.S. Cl.
CPC ..... *E04H 15/02* (2013.01); *A47K 11/04* (2013.01); *E04H 15/34* (2013.01)

(58) Field of Classification Search
CPC ..... A47K 11/04; E04H 15/02; E04H 15/34; E04H 1/1216
USPC ..... 4/476, 470
See application file for complete search history.

(56) References Cited

U.S. PATENT DOCUMENTS 5,813,160 A * 9/1998 Thoelke ..... E04H 15/001 135/901
6,681,413 B2 * 1/2004 Weiss ..... A47K 11/02 4/476
8,695,127 B2 4/2014 Hentschel
2007/0245477 A1 * 10/2007 Land ..... A47K 11/02 4/476
2014/0223657 A1 * 8/2014 Hentschel ..... E04H 15/003 4/476

* cited by examiner

*Primary Examiner* — Christine J Skubinna
(74) *Attorney, Agent, or Firm* — Hammer & Associates, P.C.

(57) ABSTRACT

A system for camouflaging a waste disposal device includes a frame and a covering surrounding the waste disposal device. The frame generally includes: a base with a pair of vertically, spaced apart, base frame members defining a lower circumferential edge of the frame; a crown with a pair of vertically, spaced apart, crown frame members defining an upper circumferential or peripheral edge of the frame, a curtain ring inset from the upper circumferential or peripheral edge; and a plurality of uprights interconnecting the base and the crown; and a door opening defined between some of the uprights, the base, and the crown. The covering generally includes: a crown fabric covering the crown; and a body fabric generally surrounding waste disposal device. Alternatively, the system includes: a frame with only the above described crown (i.e., without the base) and a covering (crown fabric and body fabric).

7 Claims, 7 Drawing Sheets

CAMOUFLAGED PORTABLE TOILET

RELATED APPLICATION

This application claims the benefit of U.S. Provisional Patent Application Ser. No. 62/967,632 filed Jan. 30, 2020, which is incorporated herein by reference.

BACKGROUND

A portable chemical toilet (also known as: 'port-a-john' or 'porta-potty' or 'portaloo' or 'honey bucket') are toilets that are often seen at constructions sites and at events, mostly outdoor events (e.g., festivals), see 'Chemical toilet,' www.wikipedia.com; 'Portable toilet,' www.wikipedia.com; and/or 'What is a Chemical toilet?' www.wisegeek.com, each incorporated herein by reference. These toilets are generally made from a molded plastic shell with four side walls and a door in one of the side walls, a top, a floor, and a toilet within the shell. These toilets are widely used and recognizable. Some, however, may think that these toilets are unsightly, particularly for some events.

In addition to the foregoing toilets, larger toilets (for example, those on a trailer—about the size of a shipping container (see Wikipedia—Shipping Container Jan. 23, 2020) and/or dumpsters (see Wikipedia—Dumpster Jan. 23, 2020), may also need to be hidden or disguised or camouflaged or decorated.

U.S. Pat. No. 8,695,127, incorporated herein by reference, discloses a system for providing an aesthetically pleasing covering of such toilets and the like.

Accordingly, there is a need for camouflaging or decorating these toilets, so that they are more attractive.

SUMMARY OF THE INVENTION

In one embodiment, a system for camouflaging a waste disposal device comprises: a frame surrounding or enclosing the waste disposal device includes: a base, the base includes a pair of vertically, spaced apart, base frame members defining a lower circumferential or peripheral edge of the frame; a crown, the crown includes a pair of vertically, spaced apart, crown frame members defining an upper circumferential or peripheral edge of the frame, the upper circumferential or peripheral edge is greater than the lower circumferential or peripheral edge, and a curtain ring inset from the upper circumferential or peripheral edge; a plurality of uprights interconnecting the base and the crown; and a door opening defined between some of the uprights, the base, and the crown; and a covering includes: a crown fabric covering the crown, the crown fabric is attached to the one of the crown frame members; and a body fabric surrounding the uprights, but not the door opening, the body fabric is attached to the one of the base frame members and the uprights.

In another embodiment, a system for camouflaging a waste disposal device comprises: a frame for camouflaging the waste disposal device includes: a crown, the crown includes a pair of vertically, spaced apart, crown frame members defining an upper circumferential or peripheral edge of the frame, and a curtain ring inset from the upper circumferential or peripheral edge; a plurality of attachment members interconnection the crown and the waste disposal device; and a door opening defined between some of the attachment members and below the crown; and a covering includes: a crown fabric covering the crown, the crown fabric is attached to the one of the crown frame members; and a body fabric surrounding the waste disposal device, but not the door opening, the body fabric is hangs from the curtain ring.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
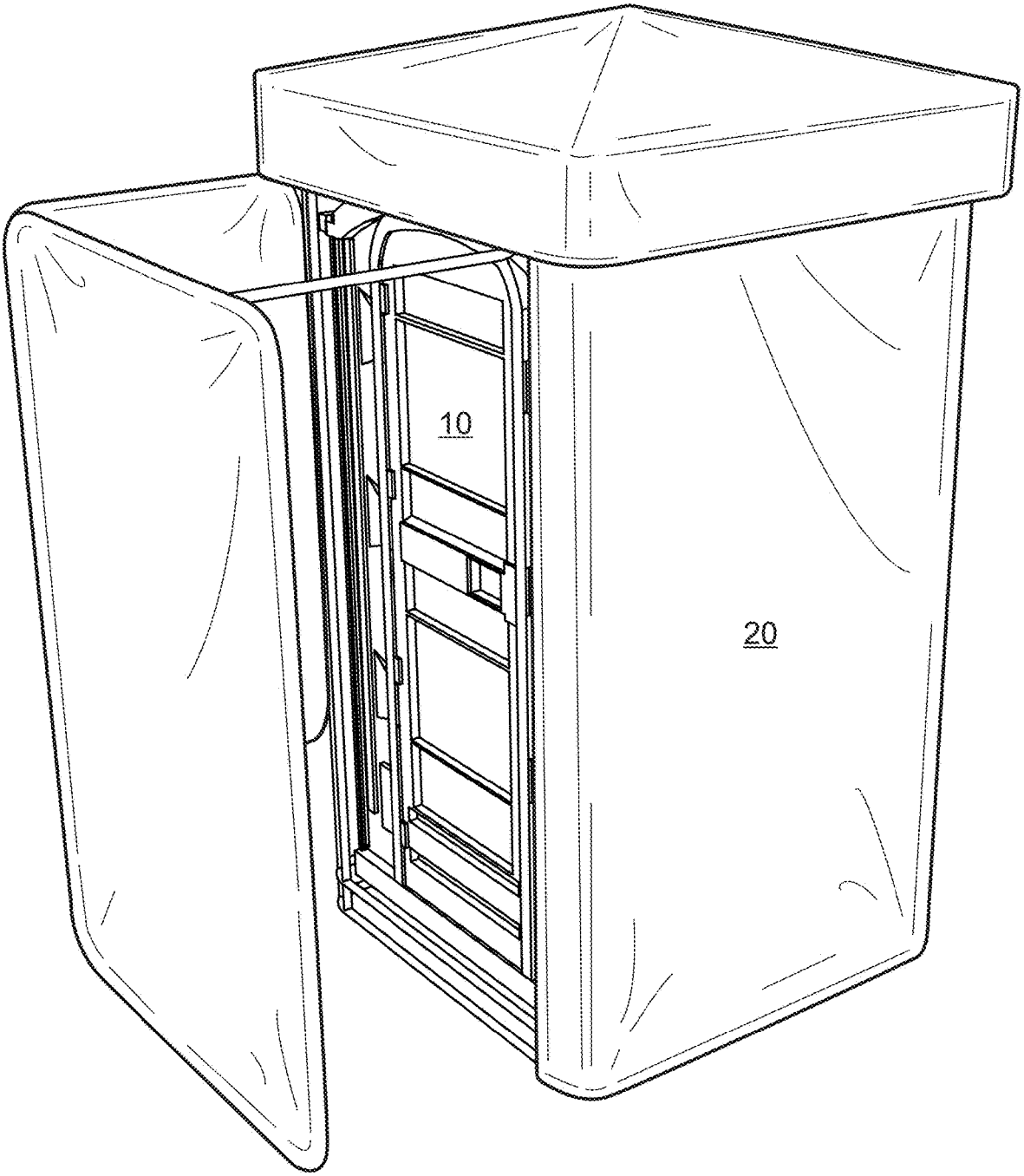
FIG. 1 is an oblique view showing an embodiment of a camouflaged portable toilet according to the instant invention with the covering in place.
Figure 2:
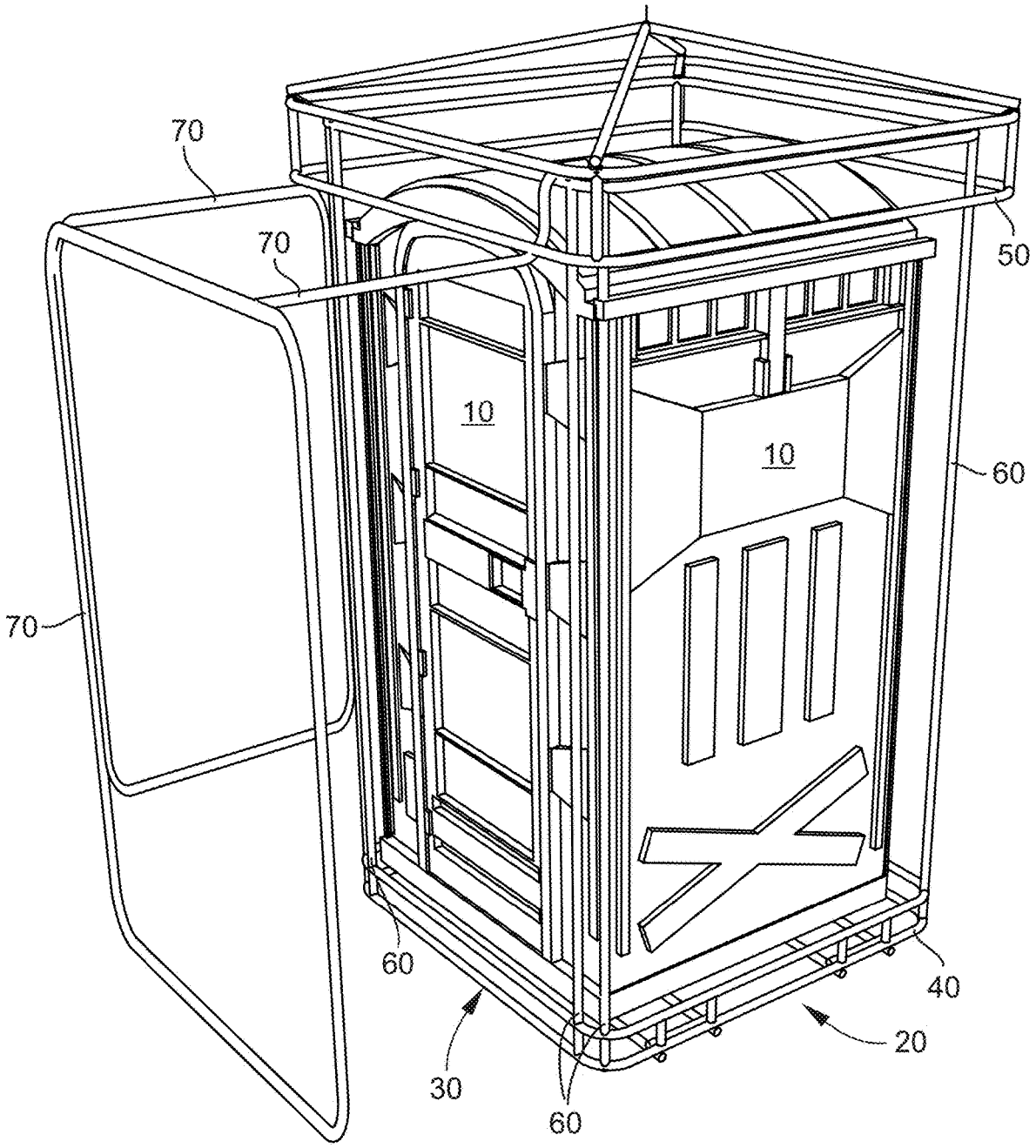
FIG. 2 shows the invention shown in FIG. 1 without the covering.
Figure 3:
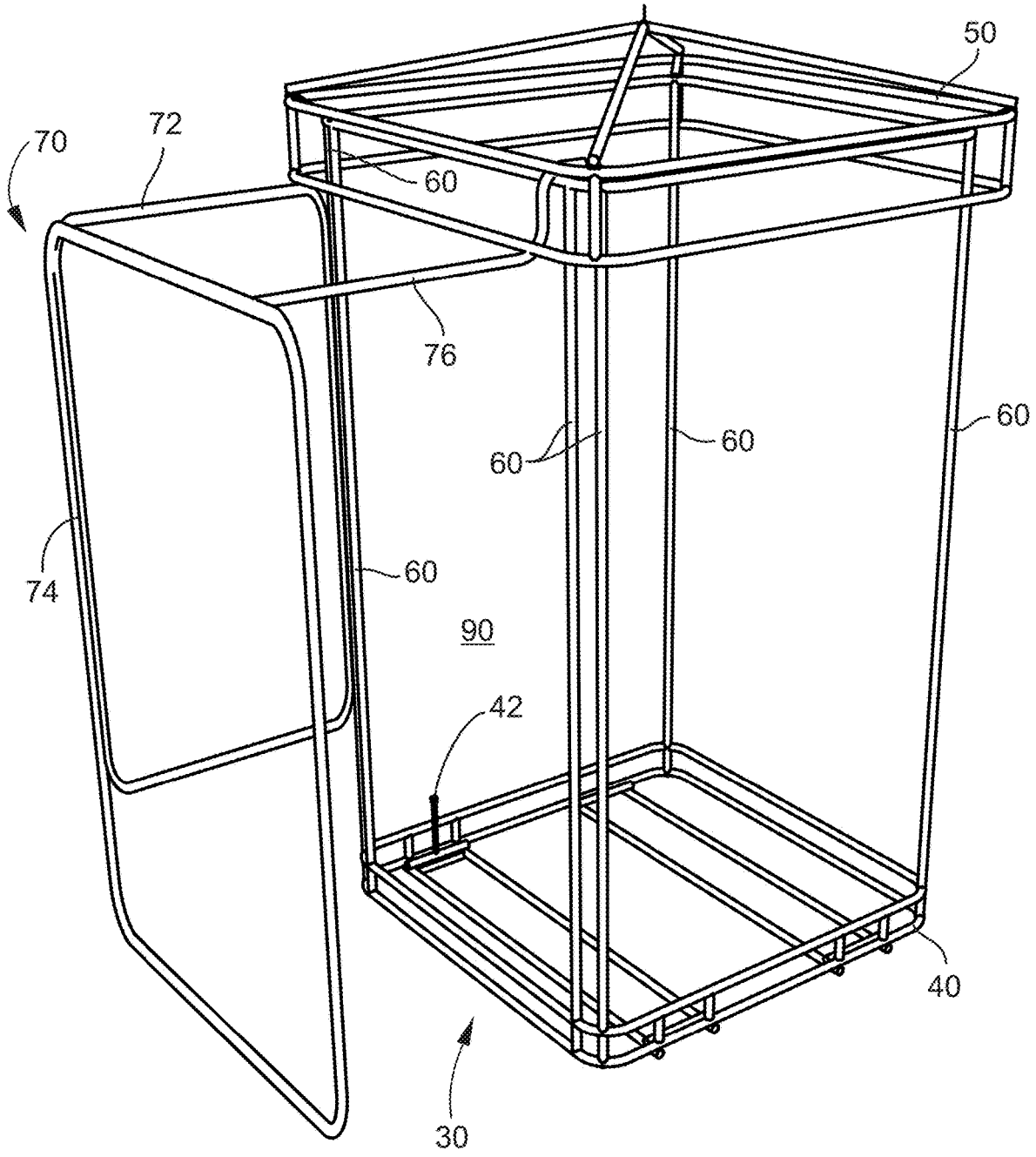
FIG. 3 shows the invention of FIG. 2 without the portable toilet.
Figure 7:
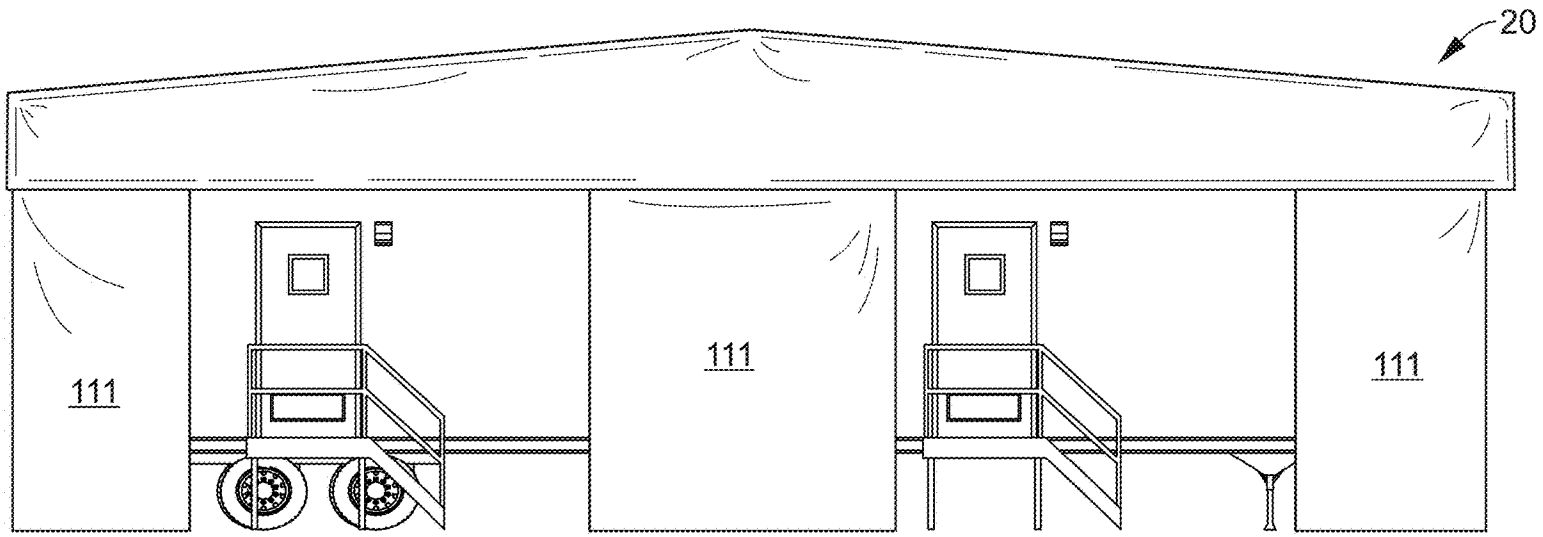
FIG. 7 shows an alternate embodiment of the invention with cover in place.

Referring to the attached figures and the following description and claims, several embodiments of the system for camouflaging a waste disposal device are disclosed. FIG. 1 shows a waste disposal device 10 (a portable toilet) enclosed within an embodiment of the invention 20. FIG. 2 shows the portable toilet 10 surrounded by the frame 30 of the invention 20 (no covering 80 is shown). Frame 30 of this embodiment generally includes: base 40, crown 50, uprights 60, and an optional privacy frame 70. FIG. 3 shows frame 30 without the portable toilet. FIG. 7 shows an alternate embodiment of the invention.

A waste disposal device 10 may be any waste disposal device. For example, a waste disposal device may include; but is not limited to: a portable toilet, a trailer based toilet(s), a dumpster, and/or the like.

Frame 30 may be made of any material that can structurally withstand the rigors of the application. Frame 30 may be made of, but is not limited to, metal members, wood members, plastic members, or any combination thereof. Frame 30 may be tubular members or solid members, Frame 30 members may have any cross-section.

For example: cross-sections include, but is not limited to: annular (circular, square, rectangular, elliptical), circular, square, rectangular, 'L', and the like, and combinations thereof. In some embodiments, frame 30 may be made with commercially available electrical conduit. Other aspects of the frame 30 are discussed below.

Covering 80 is a fabric. The fabric may be any fabric that is sufficiently tough to withstand the rigors of the application. Such fabrics may be woven, nonwoven, and/or knitted. The fabric may be made of any material. Such materials include, but is not limited to, synthetic materials. Synthetic materials include, but is not limited to: polyolefins, nylons, polyesters, and combinations thereof, and the like. In some embodiments, the material may be UV protected and/or flame protected. In some embodiments the peripheral edge portion of the fabric may include a plurality of grommets and/or a plurality of hooks, each of which may be used to secure the covering to the frame (as is well known).

Figure 4:
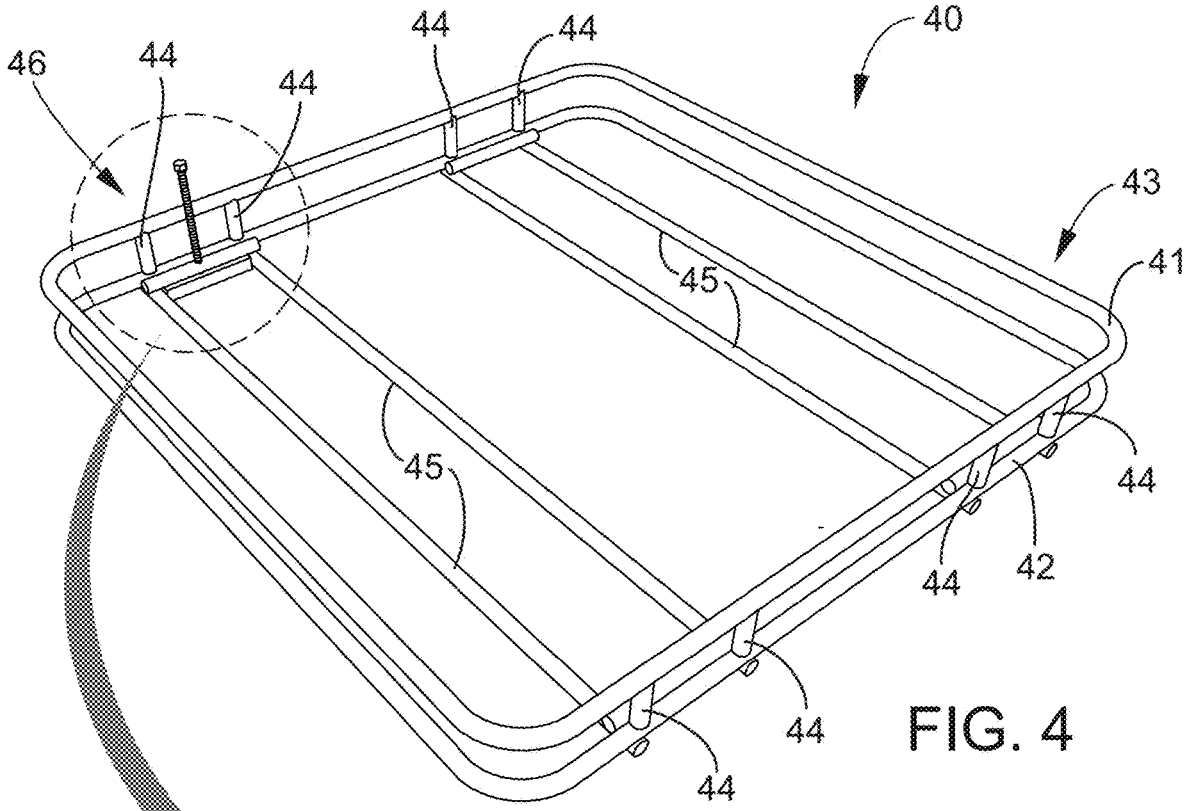
FIG. 4 shows an embodiment of the base of the invention.
Figure 5:
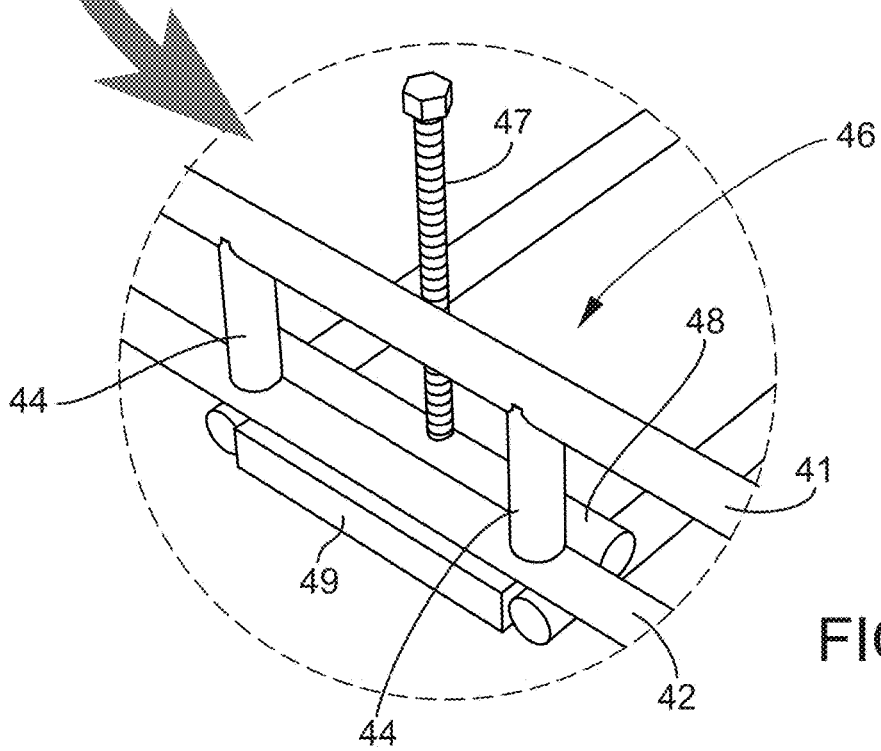
FIG. 5 shows an enlarged view of an embodiment of a part of the base shown in FIG. 4.

In general, frame 30 (best seen in FIG. 3) includes: base 40 (also see FIGS. 4 and 5); crown 50 (also see FIG. 6), uprights 60, and optional privacy frame 70 adjacent door opening 90 (which in turn is adjacent the door of the waste disposal device).

Base 40 includes a pair of vertically, spaced apart, base frame members 41, 42 defining a lower circumferential or peripheral edge 43. Members 41, 42 are spaced apart, interconnected, and affixed together by base spacers 44. Lateral sides of members 42 are interconnected and affixed together by cross members 45.

Leveling jack 46 (see FIG. 5) may be included with base 40. Jack 46 may be any leveling jack. In one embodiment, jack 46 may include a threaded member 47, a mating member 48, and a foot 49. Mating member 48 is affixed to the base 40, so that as threaded member 47 is turned (or twisted), the threaded member 47 bears against foot 49 to raise or lower base 40 (as is well known). Base 40 may include one or more leveling jacks 46.

Figure 6:
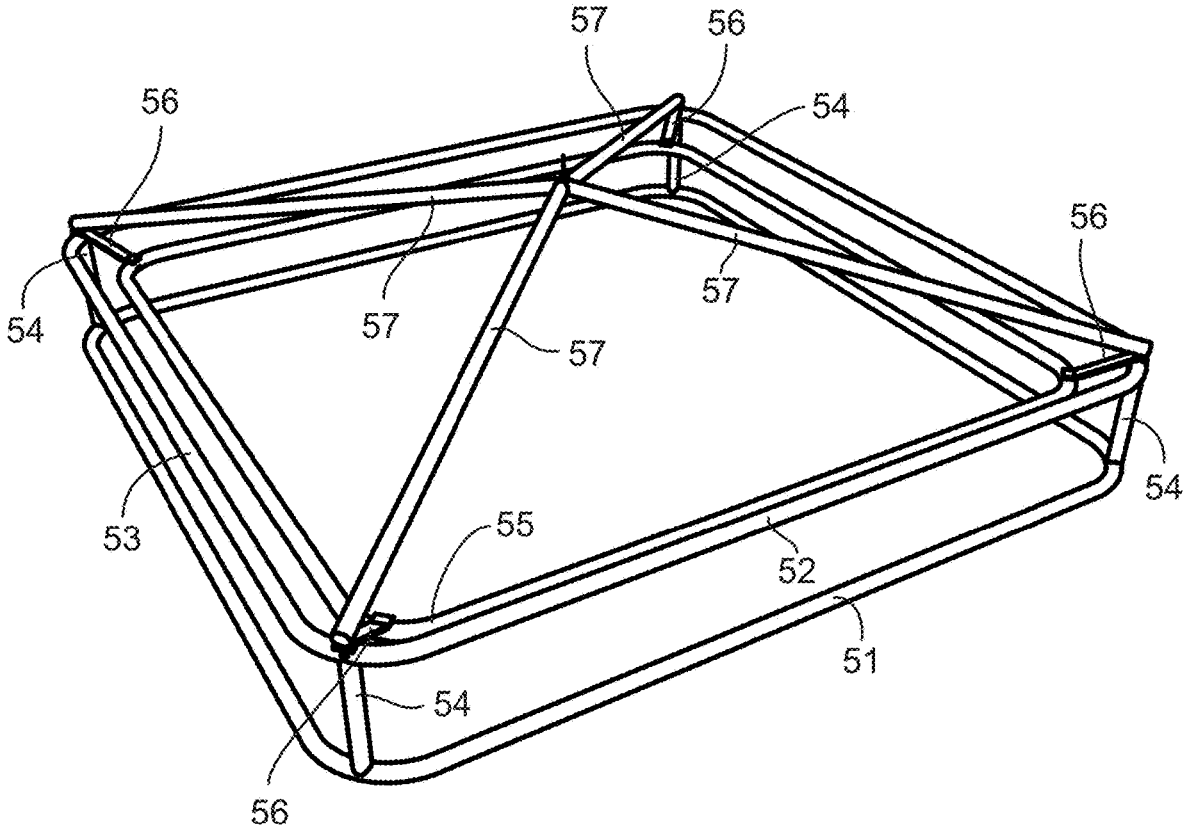
FIG. 6 shows an embodiment of the crown.

Crown 50 (see FIG. 6) includes a pair of vertically, spaced apart, crown frame members 51, 52 defining an upper circumferential or peripheral edge 53 of the frame 30. Members 51, 52 are spaced apart, interconnected, and affixed together by crown spacers 54. The upper circumferential or peripheral edge 53 may be greater than the lower circumferential or peripheral edge 43. A curtain ring 55 is inset from the upper circumferential or peripheral edge 53 and connected to members 51, 52 by connectors 56. Roofing frame members 57 may be provided. Members 57 may be used to create any style of roof design. Such roof design may include, but not limited to: flat, shed, gable, hip, gambrel, mansard, butterfly, Dutch gable, and the like. In FIG. 6, a pyramidal hip roof style is shown.

Uprights 60 interconnect the base 40 to crown 50. Interconnection, as used herein, may be any connection method. Such connection methods include: but is not limited to: threaded rod and mating bushing, detent, friction fit, and/or clamp. The connection method should be sufficiently rigorous to withstand multiple assembly and disassembly of the invention 20. Uprights 60 may interconnect the base 40 and crown 50 between, for example, base member 41 and crown curtain ring 55. In some embodiments, the uprights 60 may be in multiple pieces (e.g., 2+). Two or more uprights 60 may be used to define the lateral sides of a door opening 90.

Privacy screen frame 70, in the embodiment shown (see FIG. 3), may generally include: a first screen frame member 72, a second screen frame member 74, and a support bar 76. Screen member 72 is adjacent the door opening 90, is connected to an upright 60, and projects away from the frame 30 (e.g., perpendicular). Screen member 74 may be generally parallel to opening 90, is connected to the screen member 72, and projects away therefrom. Support bar 76, at one end, is connected to frame 30 (e.g., via crown 50) and, at the other end, supports the free end of the screen member 74.

Figure 8:
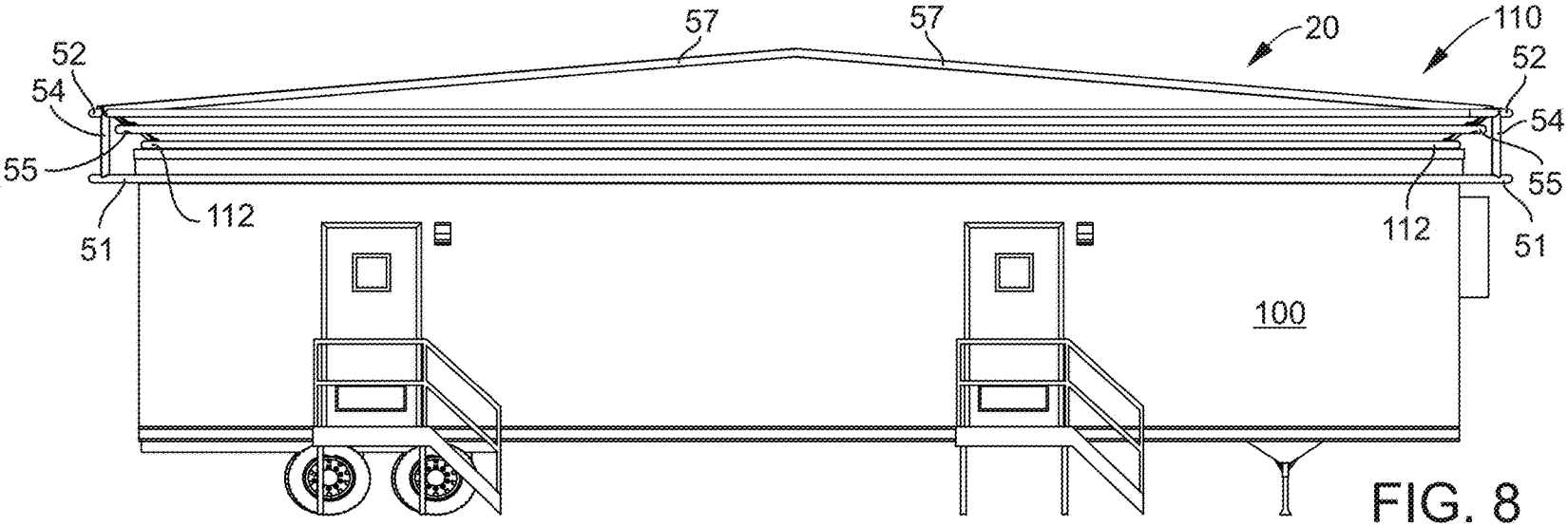
FIG. 8 shows the alternate embodiment of FIG. 7 without the cover. embodiment.
Figure 9:
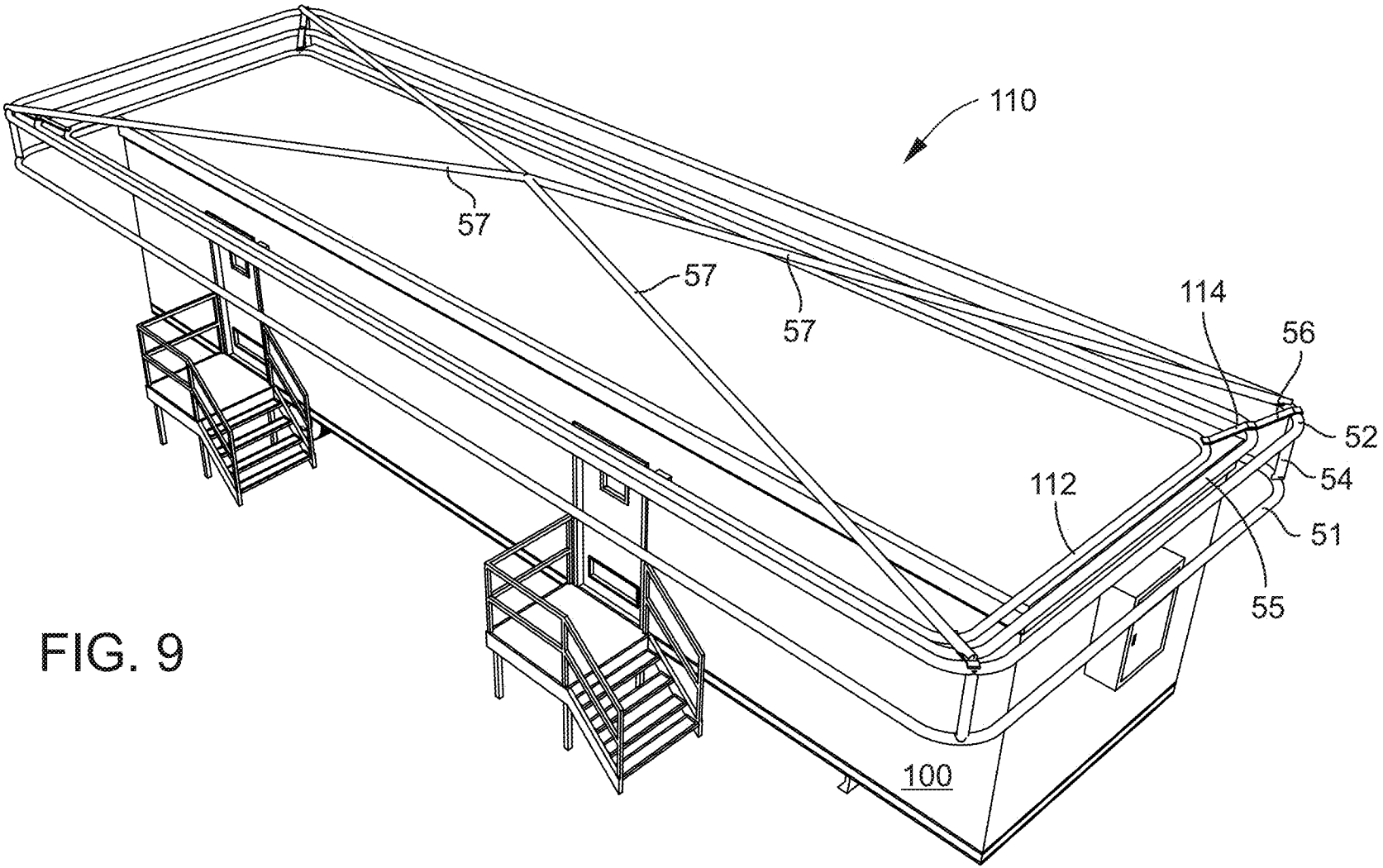
FIG. 9 shows a crown of the alternate embodiment of FIG. 7.

In an alternate embodiment (see FIGS. 7-9), the invention 20 is adapted for use without the previously described base 40 and uprights 60. FIG. 7 shows the invention 20 with cover camouflaging a trailer with multiple toilets. FIG. 8 shows the uncovered invention 20 with the crown 110 resting (or connected to), in any conventional manner, on the top surface of a trailer 100. Crown 110 is covered, as previously described, and curtains 111 hang from the curtain ring 55 (best seen in FIG. 9). Crown 110 is similar to the previously described crown 50, except as described hereinafter. Referring to FIG. 9, crown 110 has attachment members that may include an additional member 112 that is interconnected to crown 110 via connectors 114. Crown 110 may extend beyond a side of the trailer 110 thereby forming an awning. Additional member 112 is inset from curtain ring 55 and may be adapted to rest on (or be connected to) trailer 100. Connectors 114 may, at one end, connect to member 112, and, at the other end, connect to curtain ring 55 and/or members 51, 52. In this embodiment, the crown 110 is covered with fabric, as described above, and curtains 111 cover the wall of the trailer, but are open at doorways allowing access to the trailer.

In another alternate embodiment (not shown), the invention 20 is adapted for use around a large dumpster and/or container. In this embodiment, base 40 without cross members is used, uprights 60 and crown 50 optionally without roofing members 57 (removal of members 57 allows access into the top of, for example, a dumpster).

The present invention may be embodied in other forms without departing from the spirit and the essential attributes thereof, and, accordingly, reference should be made to the appended claims, rather than to the foregoing specification, as indicated the scope of the invention.

I claim:

1. A system for camouflaging a waste disposal device comprises:

- a frame surrounding or enclosing the waste disposal device includes
  - a base, the base includes a pair of vertically, spaced apart, base frame members defining a lower circumferential or peripheral edge of the frame;
  - a crown, the crown includes a pair of vertically, spaced apart, crown frame members defining an upper circumferential or peripheral edge of the frame, the upper circumferential or peripheral edge is greater than the lower circumferential or peripheral edge, and a curtain ring inset from the upper circumferential or peripheral edge;
  - a plurality of uprights interconnecting the base and the crown; and
  - a door opening defined between some of the uprights, the base, and the crown; and
- a covering includes
  - a crown fabric covering the crown, the crown fabric is attached to the one of the crown frame members; and
  - a body fabric surrounding the uprights, but not the door opening, the body fabric is attached to the one of the base frame members and the uprights.

2. The system of claim 1 further comprising a screw jack affixed to the base for leveling the waste disposal device.

3. The system of claim 1 wherein each upright includes an upper portion and a lower portion and each said portion includes a bushing for attachment to either the base or the crown.

4. The system of claim 1 further comprising a stabilizer for interconnection the frame to the waste disposal device.

5. The system of claim 1 further comprising a privacy screen attached to the frame adjacent the door opening.

6. A system for camouflaging a waste disposal device comprises:

- a frame surrounding or enclosing the waste disposal device includes
  - a crown, the crown includes a pair of vertically, spaced apart, crown frame members defining an upper circumferential or peripheral edge of the frame, and a curtain ring inset from the upper circumferential or peripheral edge;

a plurality of attachment members interconnection the crown and the waste disposal device; and a door opening defined between some of the attachment members and below the crown; and a covering includes a crown fabric covering the crown, the crown fabric is attached to the one of the crown frame members; and a body fabric or curtain surrounding the waste disposal device, but not the door opening, the body fabric or curtain hangs from the curtain ring.

7. The system of claim 6 further comprising a privacy screen adjacent the door opening.

* * * * *